US007082807B2

(12) United States Patent
Hoorelbeke

(10) Patent No.: US 7,082,807 B2
(45) Date of Patent: Aug. 1, 2006

(54) FORGING PRESS COMPRISING AN ADJUSTING DEVICE ON THE MATRIX SIDE THEREOF

(75) Inventor: Luc Hoorelbeke, Grobbendonk (BE)

(73) Assignee: Nedschroef Herentals NV, Herentals (BE)

( * ) Notice: Subject to any disclaimer, the term of this patent is extended or adjusted under 35 U.S.C. 154(b) by 396 days.

(21) Appl. No.: 10/433,821

(22) PCT Filed: Dec. 17, 2001

(86) PCT No.: PCT/EP01/14905

§ 371 (c)(1),
(2), (4) Date: Jun. 6, 2003

(87) PCT Pub. No.: WO02/49788

PCT Pub. Date: Jun. 27, 2002

(65) Prior Publication Data

US 2004/0040362 A1 Mar. 4, 2004

(30) Foreign Application Priority Data

Dec. 18, 2000 (DE) ..... 100 63 154

(51) Int. Cl.
*B21J 13/03* (2006.01)

(52) U.S. Cl. ..... 72/345; 470/141; 470/152

(58) Field of Classification Search ..... 72/345, 72/361, 405.12; 470/141, 152, 154
See application file for complete search history.

(56) References Cited

U.S. PATENT DOCUMENTS

| | | | | |
|---|---|---|---|---|
| 1,718,265 | A * | 6/1929 | Ward | 470/141 |
| 3,559,446 | A | 2/1971 | Dom et al. | |
| 4,137,748 | A | 2/1979 | Grombka | |
| 4,170,051 | A | 10/1979 | O'Keefe et al. | |
| 4,791,803 | A | 12/1988 | Broquet et al. | |
| 4,966,028 | A * | 10/1990 | Sakamura et al. | 72/361 |
| 5,067,892 | A * | 11/1991 | Rahn et al. | 425/556 |

FOREIGN PATENT DOCUMENTS

| | | |
|---|---|---|
| JP | 59-94549 | 9/1984 |
| JP | 04075742 A | 10/1992 |
| JP | 09295095 A | 11/1997 |

* cited by examiner

*Primary Examiner*—Lowell A. Larson

(74) *Attorney, Agent, or Firm*—Head, Johnson & Kachigian

(57) ABSTRACT

A forging press in which adjustment of the tool positions relative to each other can be quickly and easily carried out, in spite of involving a low level of structural complication and expenditure, in particular by virtue of good accessibility, and especially with a low degree of susceptibility to trouble, with a support side which is stationary in the shaping procedure and which includes a die, an impact side which includes a carriage with a punch, the carriage being movable in the longitudinal direction in the shaping procedure, and a first setting device for setting the closing height spacing, wherein the first setting device is arranged on the support side of the forging press.

12 Claims, 7 Drawing Sheets

42
IV 100
101
15
40
S
IV
1
2
15
21

FORGING PRESS COMPRISING AN ADJUSTING DEVICE ON THE MATRIX SIDE THEREOF

CROSS-REFERENCE TO RELATED APPLICATION

This is a United States National Phase Application of PCT/EP01/14905 entitled "Forging Press With Setting Device on the Die Side" which has an International filing date of 17 Dec. 2001 and which claims priority to German Patent Application No. 10063154.1 filed 18 Dec. 2000.

BACKGROUND OF THE INVENTION

The invention concerns improvements in the adjustment of tools of forging presses.

In forging presses, in particular horizontal transfer presses, a workpiece is put into the desired shape by a shaping operation, by a procedure whereby the workpiece is so firmly pressed between a fixed die and a movable ram or punch that the desired shaping effect takes place.

In such an arrangement, in operation of the machine, the ram or punch is not generally moved to a position in which it bears against the die, but is only moved to a so-called closing height spacing which is naturally crucial in terms of the result of the shaping procedure.

By virtue of fluctuations in the dimensions of the blank, thermally induced expansion of the machine as a result of on-going operation thereof and so forth, that closing height spacing must be settable, that is to say subsequently adjustable.

As the closing height spacing is a spacing which is measured in the longitudinal direction, that is to say in the direction of the pressing stroke movement, that effect was hitherto achieved by providing a setting device on the side of the movable ram or punch, that is to say on the impact side of the machine. The setting device pushes a setting wedge member in the wedge direction, transversely with respect to the longitudinal direction, to a greater or lesser distance between the movable ram or punch and the remainder of the movable carriage carrying the ram or punch.

In that way, the stroke movement, which is always identical, in regard to the drive of the carriage is not altered, on the side of the ram or punch, in terms of the stroke distance, but it is in fact altered in terms of the longitudinal position at the two motion-reversal points, and that also means that the closing height spacing relative to the stationary die is altered.

A structure of that kind is described for example in DE 197 22 229 A1, wherein the setting device is driven by motor means.

A disadvantage however is that the entire setting device is disposed in the moved part of the machine, the impact side, and not in the stationary support side. That is a disadvantage by virtue of the high acceleration forces involved (about 300 stroke per minute) while in addition there is also the disadvantage that for repair operations, not only is it necessary for the machine to be stopped, but under some circumstances it is also necessary for the complete carriage to be dismantled, which gives rise to major losses in production.

SUMMARY OF THE INVENTION

Therefore the object of the present invention is to provide a forging press in which adjustment of the tool positions relative to each other can be quickly and easily carried out, in spite of involving a low level of structural complication and expenditure, in particular by virtue of good accessibility, and especially with a low degree of susceptibility to trouble.

That object is attained by the features of claim 1. Advantageous embodiments are set forth in the appendant claims.

By virtue of the fact that the setting device is disposed not on the impact side but on the support side of the machine, it is exposed to considerably lower levels of loading during operation of the machine and accordingly has to be maintained or replaced less frequently.

This structure is suitable in particular for horizontal transfer presses in which therefore the longitudinal direction of the machine, the stroke direction, is arranged horizontally, and which are integrated into a transfer line so that the workpieces are transported transversely with respect to the longitudinal direction of the individual machine from one processing station to the next, by means of a transfer device.

In this respect, in particular transportation can be effected from a forging position to the next one, possibly within the same machine, but into a different tool, if the machine includes a plurality of tools, that is to say dies and punches, in mutually juxtaposed relationship.

This arrangement is also particularly suitable for forging presses in which operation is not effected with endless material, for example wire material, but rather the blanks are inserted individually prior to each shaping operation into the machine, that is to say into the stationary die, which in generally is also effected automatically by means of a transfer device.

The position of the front end face which is towards the punch, the so-called abutment face, is determined in the longitudinal direction by means of the setting device, insofar as the die block in which the die is fixed and which is supported indirectly with respect to the main body of the machine is spaced therefrom to a greater or lesser extent. The spacing is preferably altered by inserting a wedge in the wedging direction and transversely with respect to the longitudinal direction, the stroke direction, to a greater or lesser extent; that wedge is preferably supported on a similarly opposite co-operating surface, of the same steepness or gradient, of a counterpart wedge member.

For operation of the machine, the die block together with the die is already biased in the longitudinal direction to bear firmly against the wedge and thus involve as little play as possible with respect to the main body.

For displacement of the wedge, that biasing action which is mostly afforded by way of a lever mechanism and a hydraulic cylinder has to be at least partially released, so that the displacement force does not have to become too high.

Adjustment is preferably effected by a motor arrangement, by means of a screwthreaded spindle which extends in the direction of displacement of the wedge and which preferably—particularly in the case of horizontal transfer presses—is in operative engagement from the underside while the workpiece feed is effected from the top side.

In order to prevent adjustment from occurring of its own accord, the screwthreaded spindle passes inter alia through a hydraulically clampable nut which is left in the clamped condition during the forging operation of the machine, in order to fix the screwthreaded spindle.

At first glance, a disadvantage with such an arrangement in which the first setting device is disposed on the support side, namely behind the die, is the fact that varying the longitudinal position of the front abutment surface of the die also varies the spacing between that front abutment surface and the rear abutment for the workpiece, which abutment is afforded by a member adjusted in the main body of the machine and projects from the rear into the die.

In the case of the workpiece to be produced, that alteration also causes a variation in the shank length L1 which is not altered by the shaping procedure, for example if the screw head is to be shaped on the blank from portions of round material which is cut to length, by virtue of being fitted into the die and by virtue of projecting beyond the front abutment surface thereof, by means of the movable ram or punch, as then the spacing between the front abutment surface and the rear abutment is altered to the shank length of the later screw on which then the screwthread is formed by rolling or pressing.

It is possible to obviate that disadvantage in that the rear abutment is not only adjustable with respect to the main body, which is in any case necessary for conversion from one workpiece to another, but its second setting device is coupled to the first setting device in such a way that, when adjusting the closing height spacing, by means of the first setting device, the second setting device is similarly also automatically adjusted, so that the shank length, that is to say the spacing between the front abutment surface and the rear abutment, remains unchanged.

It will be appreciated that it is possible for the two setting devices also to be specifically adjusted separately, in particular the second setting device.

In general, the second setting device also includes a screwthreaded spindle for the adjustment procedure, which can also be screwed in the main body, but this time in the longitudinal direction.

Coupling of the two setting devices is possible for example by virtue of the fact that the two screwthreaded spindles are respectively driven by way of an electric motor, for example a servo motor, and can be actuated by means of a common control or two individual, operationally interconnected controls.

It will be appreciated that purely mechanical coupling of the two setting devices, in particular the screwthreaded spindles thereof, is also possible, insofar as one and the same motor or also a hand drive adjusts the two screwthreaded spindles in the correct relationship relative to each other. In this case also, there must be a decoupling option in the form of a coupling arrangement so that one of the two setting devices, in particular the second setting device, can also be adjusted separately.

A further problem is represented by the transfer device which generally grips the workpiece by means of grippers immediately in front of the front end of the front abutment surface of the die and further transports it to the next processing station. By virtue of the variation in that front abutment surface, it would also be possible to vary the relative position thereof (spacing s) with respect to the transfer device.

That problem can be resolved if the transfer device is mounted on the main body, but is either displaceable and is moved by means of a setting device, in particular directly by means of the second setting device, for displacement of the abutment, or it is fixed, at a suitably large spacing s.

The clamping device for clamping and releasing the die block can also be provided with a further clamping device for clamping and releasing the transfer device relative to the main body, or it additionally clamps or releases same with respect to the die block.

BRIEF DESCRIPTION OF THE DRAWINGS

An embodiment in accordance with the invention is described in greater detail hereinafter by way of example with reference to the drawings in which:

FIG. 1 shows a forging press in accordance with the state of the art, in which a workpiece 7 is shaped by pressing between a die 2 and a movable ram or punch 1.

BRIEF DESCRIPTION OF THE PREFERRED EMBODIMENTS

Figure 1:
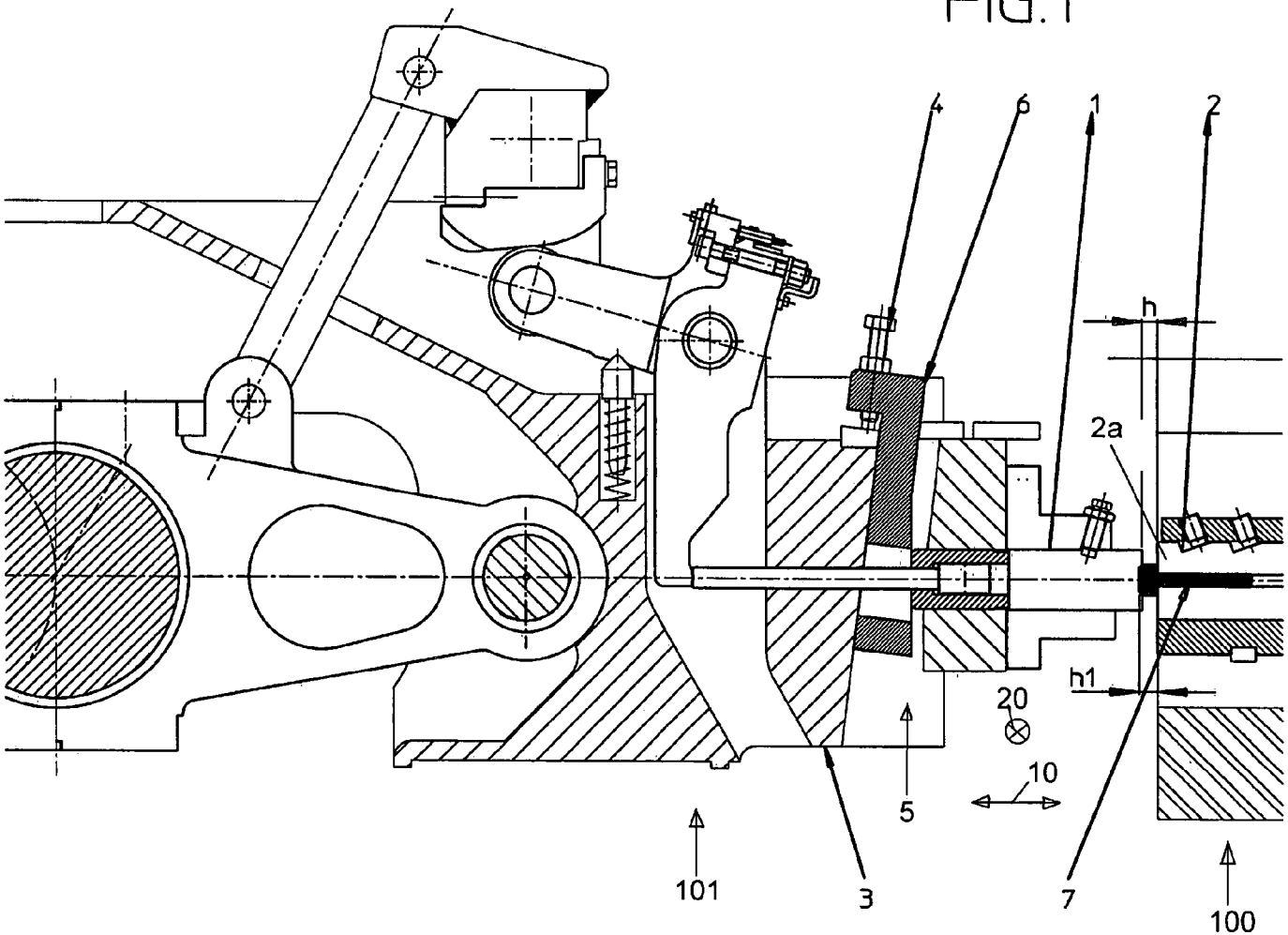
FIG. 1 is a view showing the principle of a structure in accordance with the state of the art, viewing transversely to the stroke direction of the machine.

In this case, the die 2 is accommodated in the fixed portion of the machine, being the support side 100. In contrast, the punch 1 is a component of the carriage 3 which is driven movably in the stroke direction of the press, being the longitudinal direction 10, on the impact side 101 of the machine.

In this arrangement, the carriage 3 is driven with an oscillating movement by way of a lever mechanism in the longitudinal direction 10—as illustrated in the left-hand part of FIG. 1, in which respect, in regard to the configuration of the workpiece, in this case a screw head, the important consideration is the closing height spacing h, that is to say the spacing of the punch 1 at the reversal point of its movement in the longitudinal direction 10 from the die 2, that is to say from the front abutment surface 2*a* thereof.

For that purpose, in this known structure, a wedge 6 is introduced transversely with respect to the longitudinal direction 10 between the punch 1 and the body of the carriage 3, in which respect still further components which are of invariable length can also be arranged between the wedge 6 and the punch 1.

With the stroke of the driver mechanism of the carriage 3 always being the same, the closing height spacing h and thus in this case the head height h1 of the screw head to be produced can be varied by the wedge 6 being inserted in the transverse direction to a greater or lesser extent and fixed in position, which is also effected by means of the setting bolt 4 which also extends in the direction of insertion of the wedge.

With this structure, the setting device 5 which includes the wedge 6 is disposed on the carriage 3, that is to say the part of the forging press which oscillates at high frequency; particularly in the case of a motor-driven setting device, that is to say with a motor drive for the wedge 6, that arrangement means that the drive is subjected to high levels of loading.

Figure 2A:
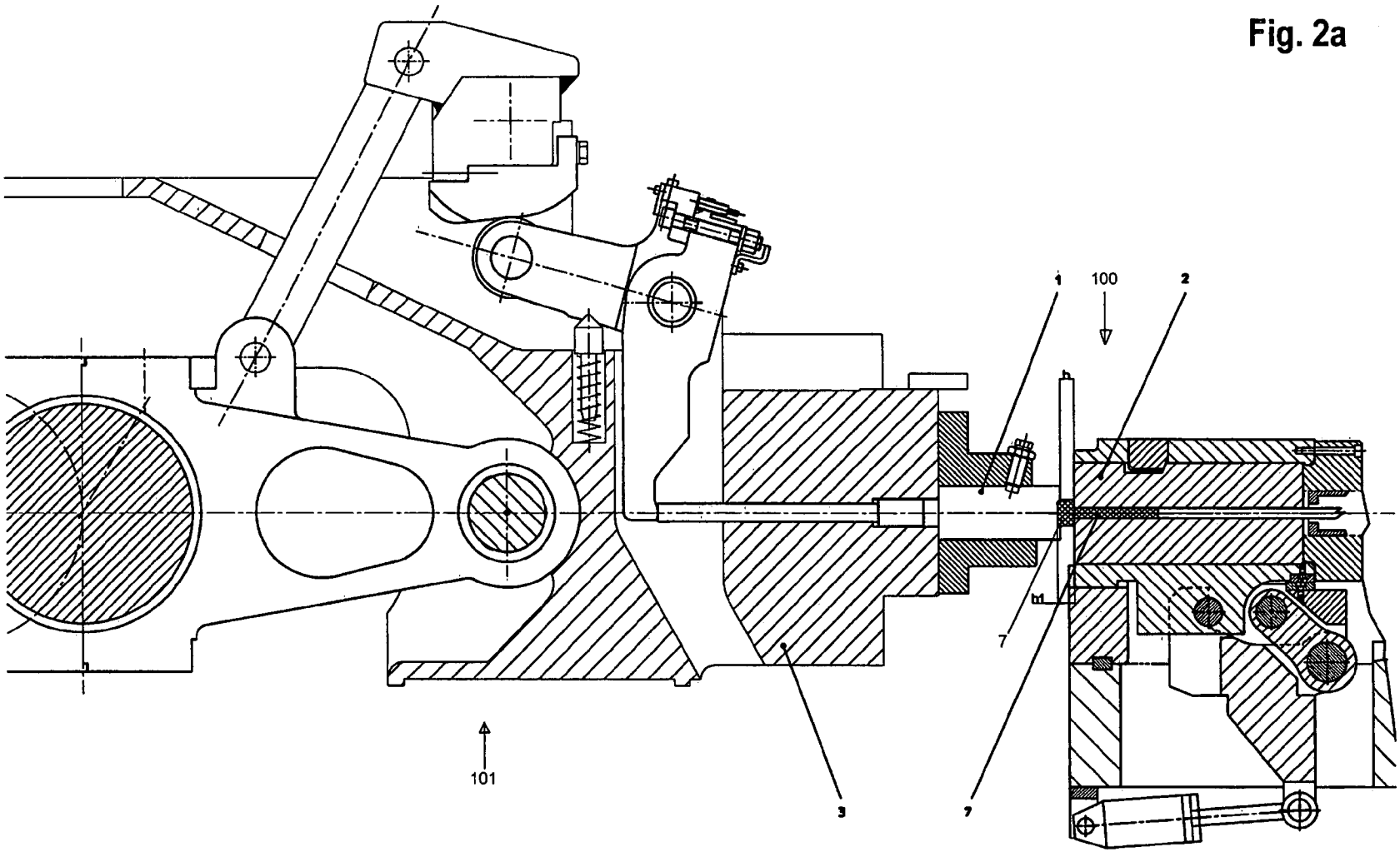
FIGS. 2*a* and 2*b* are views in the same direction showing a structure according to the invention.
Figure 2B:
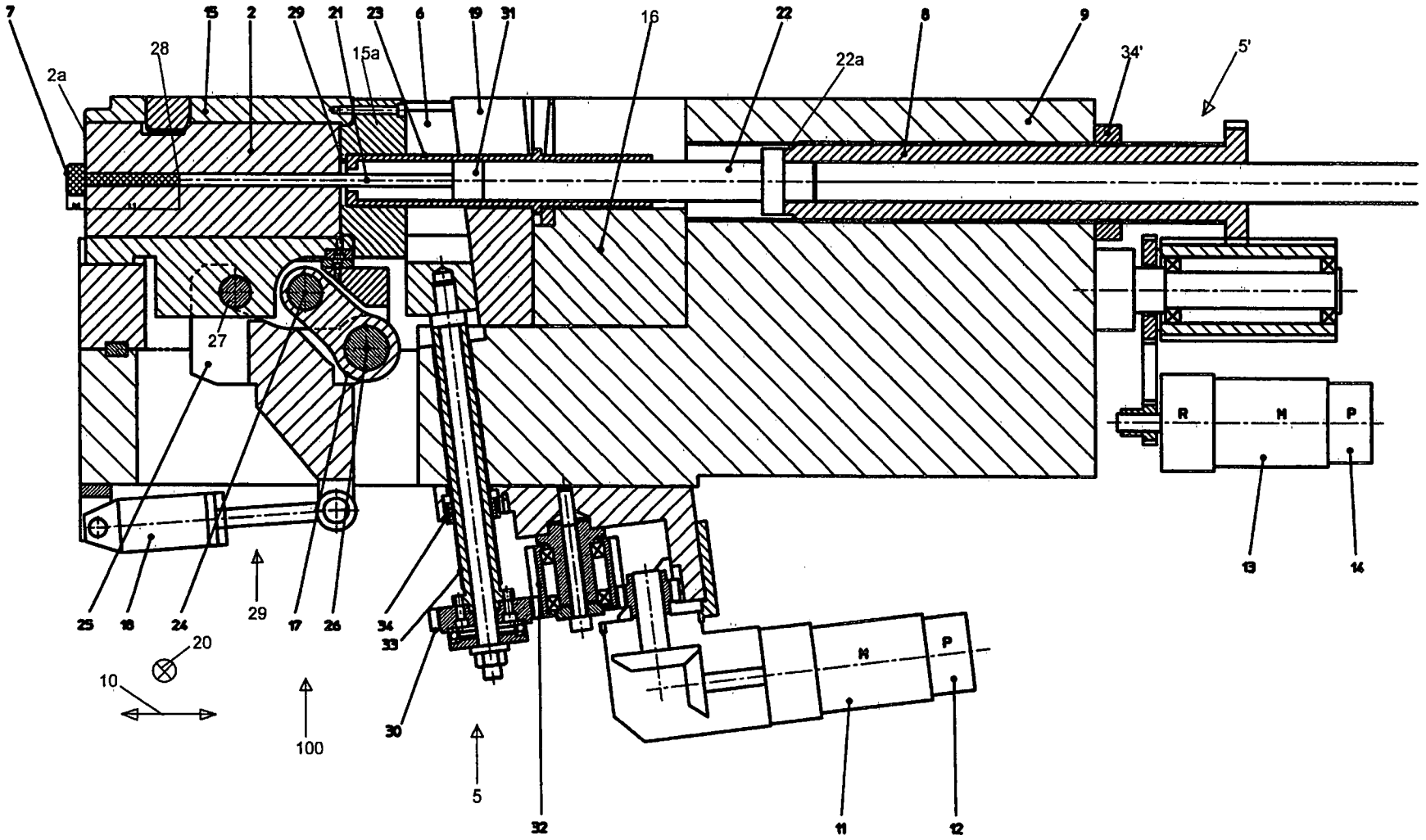
Figure 3:
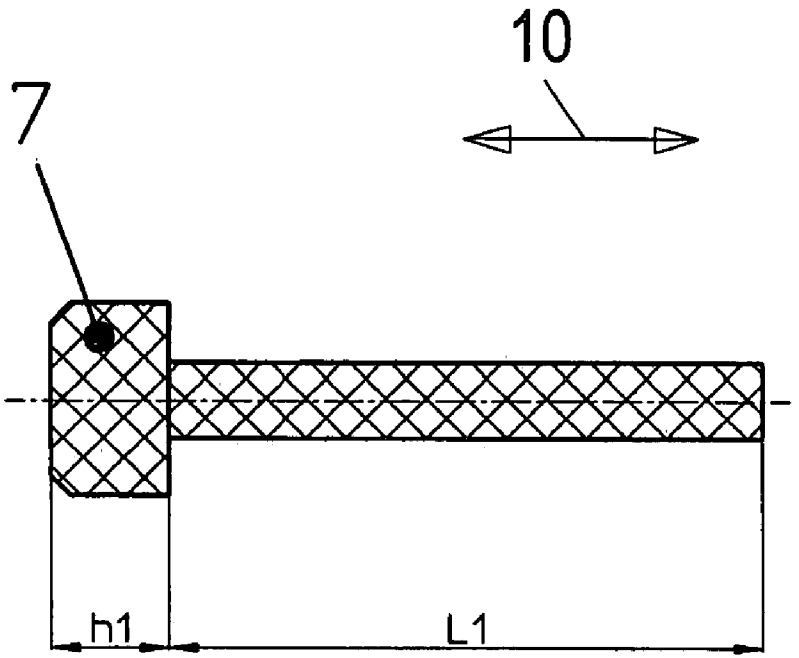
FIG. 3 is a side view of a workpiece by way of example.

FIGS. 2*a* and 2*b* therefore show the same view of a structure according to the invention of a forging press. FIG. 2*a* primarily shows the impact side 101 and FIG. 2*b* primarily shows the support side 100 of the forging press, between which the workpiece shown separately in FIG. 3 is to be disposed. The workpiece is a screw blank with a head, whose shank length is to be L1 and whose head height in the same direction, namely in the longitudinal direction of the screw and also the machine, is to be a1.

The support side 100 of the machine as shown in FIG. 2*a* differs from the known structure shown in FIG. 1 only in that the carriage 3 no longer includes a setting device for the variation in the longitudinal position of the ram or punch 1 with respect to the carriage 3, but the punch 1 is accommodated and fixed directly in a punch block which is moved with the carriage 3.

FIG. 2*b* shows the support side 100 of the forging press separately, with the workpiece 7 inserted and already shaped, that is to say after the shaping procedure has been carried out. In this case, the workpiece 7 is accommodated with its shank in a suitable bore in the die 2. The rearward free end of the shank is supported against a drive pin 21 which projects from the rear side into the bore in the die 2, as far as a predetermined position, and in that case forms an abutment 28 for the rear end of the workpiece 7.

The front free end of the blank is acted upon by the punch 1 which is not visible in FIG. 2*b*, that is to say from the left as viewing FIG. 2*a*, and, when that happens, it is deformed in such a way that the head of the blank is widened and pressed against the front end face, being the abutment surface 2*a* of the die 2.

The die 2 is accommodated in a die block 15 which is closed on the rearward side by a block cover 15*a* which is screwed thereon and which also has a through opening aligned with the bore in the die 2. The entire die block 15 including the block cover 15*a* is supported indirectly with respect to the main body 9 disposed therebehind, more specifically, by way of a support plate 16 which thus, in contrast to the main body 9, is replaceable, as a wearing member. Arranged between the support plate 16 and the die block 15 is the setting device 5 for adjustment of the longitudinal position of the die 2, that is to say the front abutment surface 2*a* thereof, with respect to the main body 9.

The setting device 5 comprises a wedge 6 whose wedge shape extends in the insertion direction which is transverse with respect to the longitudinal direction 10 and thus the stroke direction of the machine, so that the transverse position of the wedge 6 by virtue of its wedge action, determines the longitudinal position of the component which is supported against the wedge, inter alia the die 2 and therewith also the front abutment surface 2*a* thereof.

The wedge 6 is supported in turn with a wedge surface which is disposed inclinedly with respect to the radial plane, against a similarly oppositely directed, fixedly positioned co-operating counterpart wedge portion 19 which is supported with its rear side against the support plate 16. A through opening extends in aligned relationship through the wedge 6, the counterpart wedge portion 19 and the support plate 16—like the main body 9—in order to permit the feed of the ejection pin 21 which not only represents the abutment for the workpiece in the shaping procedure but which is then also intended to eject the workpiece.

Adjustment of the wedge 6 is effected by way of a screwthreaded spindle 33 which is screwed through a screwthreaded bore in the main body 9 and which is supported with its head rotatably but axially fixedly in the wedge 6 and which can displace same therefore in the displacement direction.

The rear end of the screwthreaded spindle 33 projects downwardly out of the main body 9 and is there driven by a servo motor 11 by way of a gear 30 non-rotatably connected to the screwthreaded spindle 33, and by way of a plurality of gears arranged therebetween. In that arrangement, meshing with the gear 30 is a further gear 32 whose axis of rotation is parallel to that of the screwthreaded spindle 33 and whose axial extent is as great as the displacement range of the screwthreaded spindle 33 so that the gear 30 always meshes with the gear 32, in spite of the longitudinal screwing movement.

By virtue of arranging bevel gears in the drive line, the motor is disposed at a right angle to the screwthreaded spindle 33 and is therefore positioned closely beneath the lower end of the main body 9 so that the height thereof is not unnecessarily increased.

Connected to the servo motor 11 is a position sensor 12 which, continuously or at regular time intervals or also only on demand, determines the axial position of the screwthreaded spindle 33, on the basis of a known starting position and on the basis of counting the revolutions or angular changes which have taken place in the meantime, of the servo motor 11.

The ejector pin 21 serves to support the workpiece 7 during the forging procedure, that is to say also for ejection of the workpiece 7 thereafter. The ejector pin 21 is inserted from the rear into the corresponding through bore in the die 2, which generally corresponds to the diameter of the workpiece 7 which is to be introduced into the die 2 from the other side.

It must be possible to precisely adjust the ejector pin 21, in particular in its retracted position in which its front end serves as an abutment 28 for the workpiece 7 to be introduced. That position is shown in FIG. 2*b*. In a position of the ejector pin 21 which is not shown in FIG. 2 but which is displaced towards the left in relation thereto, the ejector pin 21 can be moved forwardly to such an extent that its front end reaches or approximately reaches the front abutment surface 2 of the die.

For that purpose, at its rear end the ejector pin 21 is provided with a cylindrically enlarged head 31 which is guided in the longitudinal direction 10 in a corresponding pin bush 23 which also passes through the block cover 15*a*. A machine pin 22 presses from the rear against the head 31. The machine pin 22 is also guided with its front end in the interior of the pin bush 23 and is supported in its rearward region with a shoulder at the front end of a screwthreaded bush 8. In the operative position of the forging press, that is to say in the retracted position of the ejector pin 21 and also the machine pin 22, it bears with its rearward shoulder 22*a* against the screwthreaded bush 8. For ejection of the workpiece 7, those two are pushed forwardly in the longitudinal direction by means of an ejector which is guided in the interior of the screwthreaded bush 8 and which acts on the machine pin 22 from its rear, in the longitudinal direction.

The screwthreaded bush 8 can be screwed in the longitudinal direction by means of its male screwthread in a corresponding female screwthread in the main body 9. The screwable screwthreaded bush 8, by way of which the abutment position of the ejector pin 21 is set, is a component of the second setting device 5'. The drive for the screwthreaded bush 8 is again effected—as in the case of the first setting device 5 for adjusting the position of the wedge 6—by way of gears and a servo motor 13 as well as an associated position sensor 14 arranged behind the rearward end of the main body 9. No bevel gears are incorporated in the drive line as there is no need for the drive line to be turned through 90°.

The die block 15 including its block cover 15*a* is pressed by way of a clamping device 29 for the forging operation in the longitudinal direction and against the wedge 6 supported against the main body 9, and transversely in relation thereto against corresponding abutment surfaces on the main body 9, so as to afford an always defined position for the die 2 in the forging operation. For that purpose, a hydraulic piston 18 pulls on a lever on which there is eccentrically fixed a further lever 17 which is supported rotatably on the one hand about an axis 24 of the die block 15 and on the other hand about a pin 26 of the first lever, and the first lever is additionally fixed pivotably about a block pin 27 on the die block 15. All pivot axes extend transversely with respect to the longitudinal direction 10 and are oriented in mutually parallel relationship. By means of the clamping device 29, the die block 15, as described above, is clamped against the main body 9 and the wedge 6 respectively, and that clamping device is only released to adjust the wedge 6.

Figure 5:
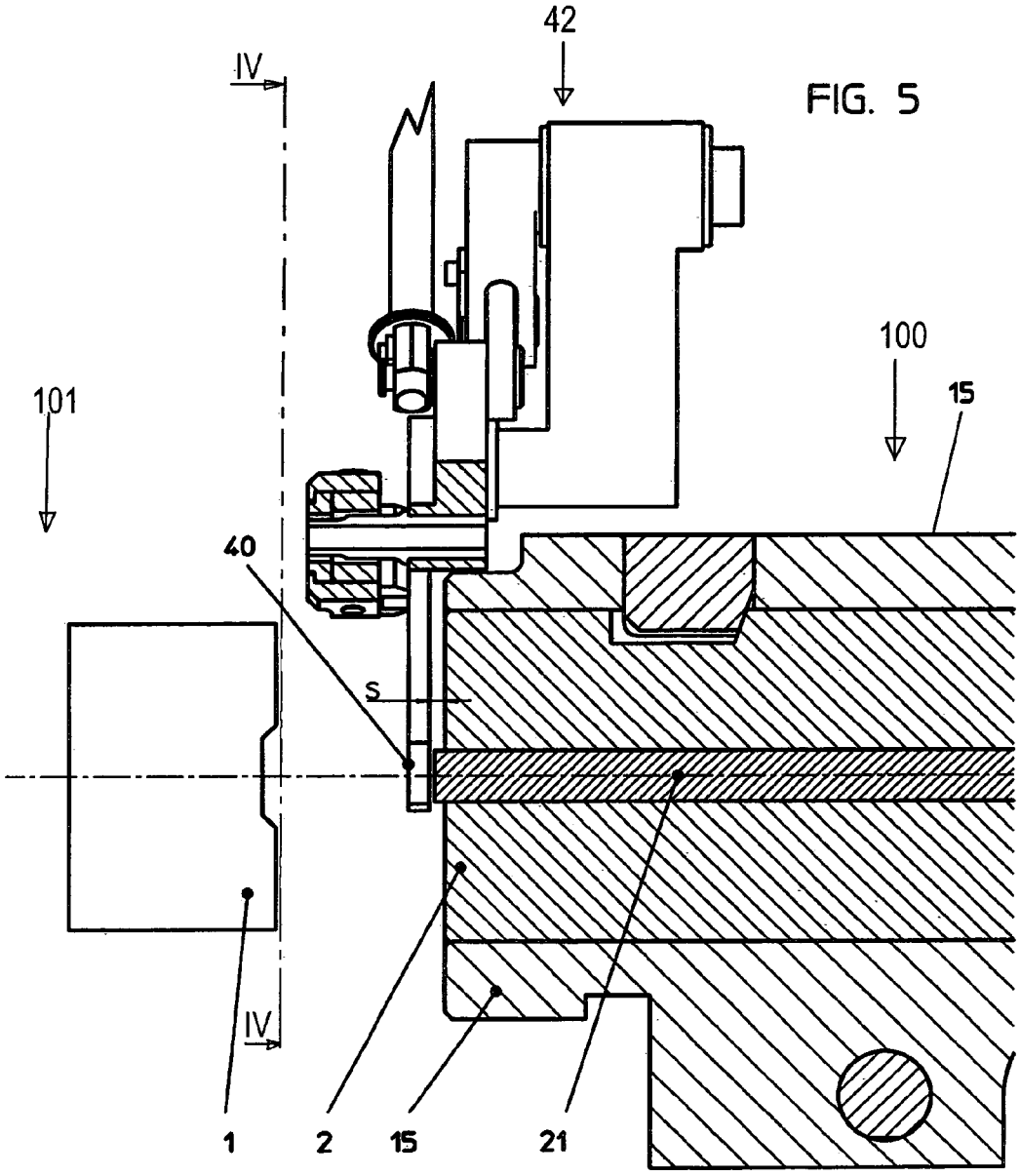
FIG. 5 shows the transfer device of FIG. 4, viewed transversely with respect to the stroke direction.

FIG. 5—viewing in a similar direction to FIG. 1 or 2—shows a transfer device 42 which is arranged above the main body and above the workpiece 7 which is not shown in FIG. 5. The ejector pin 21 is shown in FIG. 5 its advanced position, being the ejection position.

The transfer device serves to grip the workpiece by means of two grippers 40, 41 which are arranged pivotably on the transfer device 42 and which together form a tongs arrangement, and to transport the workpiece away, for example to a next processing station disposed therebeside, and/or to insert a fresh blank.

Figure 4A:
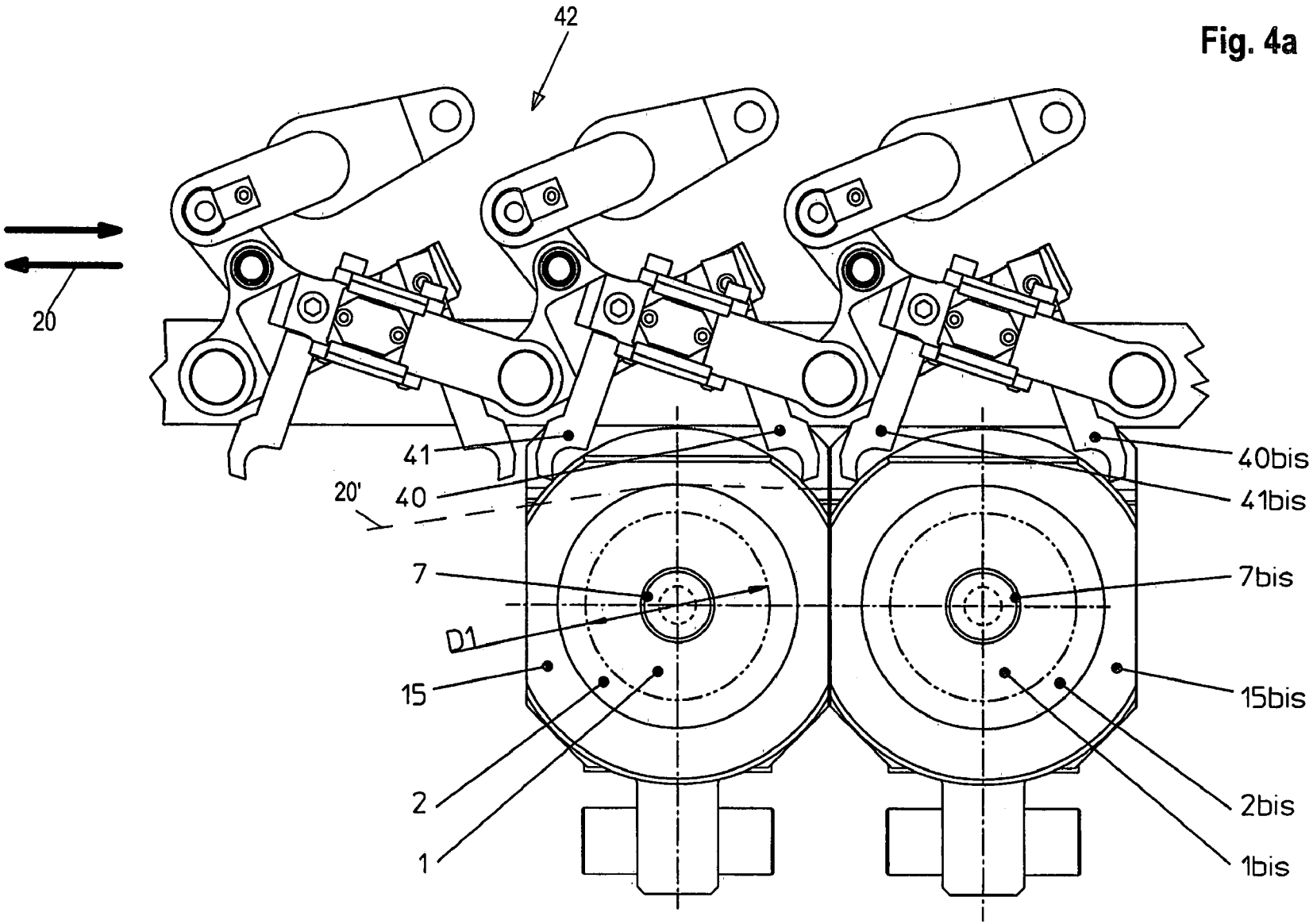
FIGS. 4*a* and 4*b* show the transfer device, viewed in the stroke direction of the machine.

For that purpose, the transfer device 42 is displaceable above the main body 9 in the transverse direction and preferably includes—as the view in FIG. 4*a* shows, with the grippers in the open condition, viewing in the longitudinal direction—at least two or even more pairs of grippers, in order to be able to carry out the unloading and loading operations simultaneously.

Figure 4B:
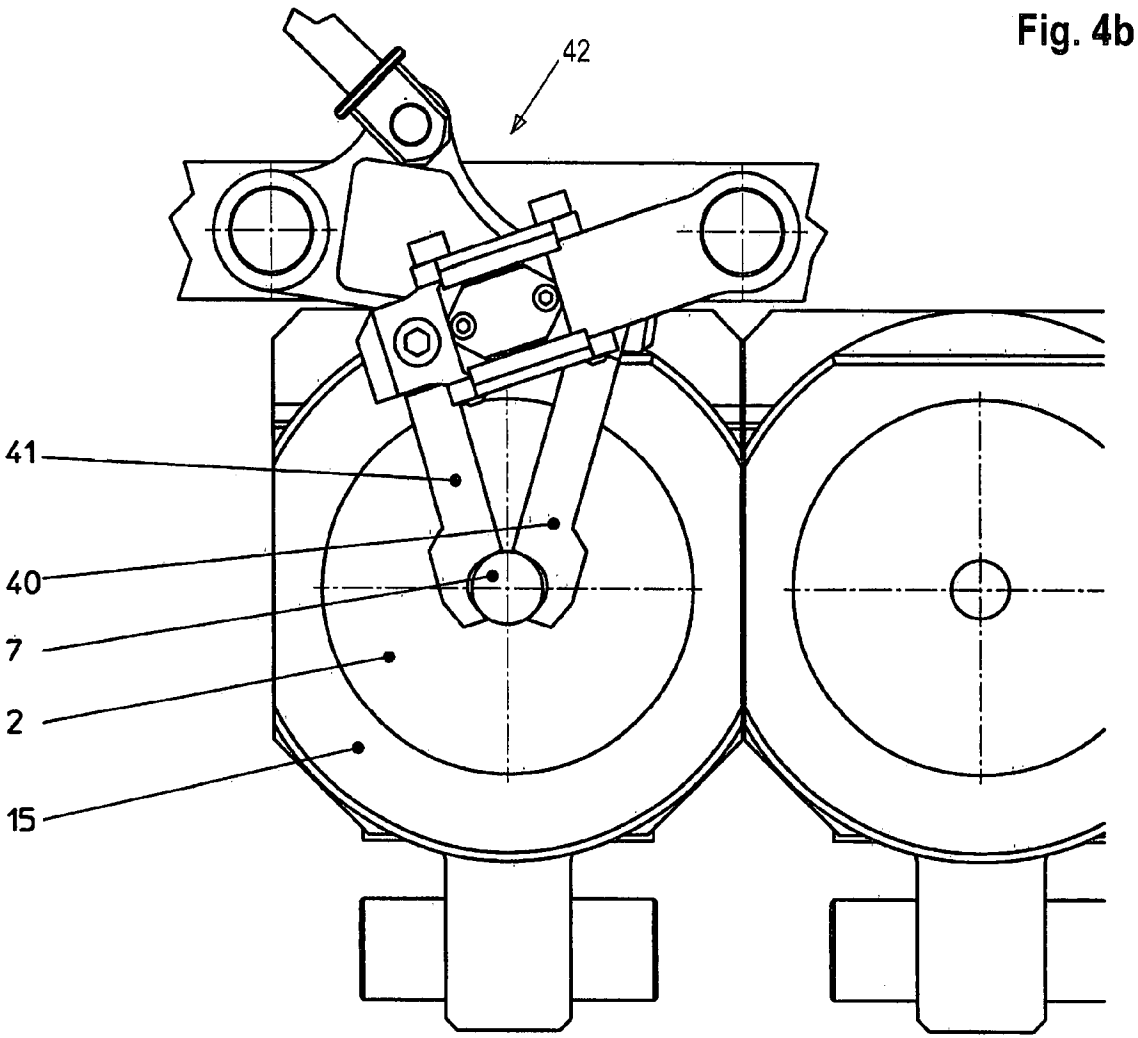

As FIG. 4*b* shows, the grippers 40, 41 are of such a length that with their free ends they can hold the workpiece 7 between them, but in the opened condition, the grippers 40, 41 pivot about their pivot axes arranged above the workpiece and in particular above the main body 9, with the extent of the pivotal movement being such that the free ends of the grippers 40, 41 do not extend down towards the die 2 beyond the highest point, namely a tangent 20' extending horizontally in the transverse direction.

By virtue of that arrangement, it is possible for the transfer device 42 to be displaced transversely, with the grippers 40, 41 in the opened condition, without the grippers 40, 41 becoming caught up on the die 2 or on the punch 1 which has still approached the die 2. As considered in the longitudinal direction, the grippers 40,41—as can best be seen from FIG. 5—are positioned immediately in front of the front end of the die 2, that is to say in front of the front abutment surface 2*a* thereof.

The spacing s between the front end face 2*a* of the die 2 and the grippers must in that respect be so adjusted that, upon adjustment of the die 2 by means of the wedge, no collision with the grippers takes place.

One possible option provides that the second setting device 5' displaces not only the ejector pin 21 but also the transfer device 42 in the longitudinal direction.

A further possible option provides that a third setting device (not shown) is provided for the transfer device 42, similarly to the second setting device 5' and operative in the same direction.

While the invention has been described with a certain degree of particularly, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled

LIST OF REFERENCES

1 punch
2 die
2*a* front abutment surface
3 carriage
4 bolt
5, 5' setting device
6 wedge 40
7 workpiece
8 (screwthreaded) bush
9 main body
10 longitudinal direction
11 servo motor
12 position sensor
13 servo motor
14 position sensor
15 die block
15*a* block cover
16 support plate
17 lever
18 hydraulic cylinder
19 counterpart wedge portion
20 transverse direction
21 ejector pin
22 machine pin
23 pin bush
24 axis
25 lever
26 pin
27 block pin
28 abutment
29 clamping device
30 gear
31 head
32 gear
33 screwthreaded spindle
34 hydraulic nut
40 gripper
41 gripper
42 transfer device
L1 shank length
h1 head height
h closing height spacing

The invention claimed is:

1. A forging press, said press comprising:

a support side being stationary in a shaping procedure, said support side including;

a main body, a die having a front abutment surface and a rear side, a workpiece having rearward and forward ends, an abutment, having a front and rear end, for said rearward end of said workpiece, a first setting device having a screw threaded spindle arranged on said support side for setting a closing height spacing, a second setting device having a screw threaded spindle for adjustment of a longitudinal position of said abutment with respect to said front abutment surface of said die, said first and second setting devices are coupled by coupling of said screw threaded spindles or by a common control of said screw threaded spindles such that a change in the closing height spacing by means of said first setting device automatically causes consequential adjustment of said abutment by means of said second setting device so that spacing between said front abutment surface of said die and said abutment remains unchanged; and an impact side having a carriage with a punch, the carriage being movable in a longitudinal direction in the shaping procedure.

2. A forging press according to claim 1 wherein said first setting device is arranged between said rear side of said die, which is remote from said impact side, and said main body of said forging press.

3. A forging press according to claim 1 wherein said support side includes at least one wedge having a front side, the at least one wedge being displaceable transversely with respect to said longitudinal direction and being wedge-shaped in that direction of view and being displaceable on a co-operating counterpart wedge portion which is similarly oppositely wedge-shaped in the same direction of view and which is stationary with respect to said main body.

4. A forging press according to claim 3 wherein said support side of said forging press includes a clamping device for fixedly clamping an entire die block carrying said die against said front side of said wedge and thus against said main body.

5. A forging press according to claim 4 wherein said clamping device is coupled to said first setting device so that prior to displacement of said first setting device said clamping device is released.

6. A forging press according to claim 1 wherein said first and second setting devices are respectively adjusted by way of said screwthreaded spindles extending in a setting direction.

7. A forging press according to claim 6 wherein said screwthreaded spindle of said first setting device runs in a hydraulically clampable nut which is clamped during operation of said forging press in order to prevent said first setting device being adjusted of its own accord.

8. A forging press according to claim 1 wherein said forging press includes a transfer device with at least one gripper each having an opened and a closed condition for gripping said workpiece and transporting said workpiece to and away from said forging press in a transverse direction with respect to said longitudinal direction.

9. A forging press according to claim 8 wherein in said opened condition said at least one gripper is outside the parts of said forging press which are in a pressing position and is outside said punch which is in the pressing position.

10. A forging press according to claim 9 wherein in said opened position said at least one gripper of the said transfer device is disposed completely radially outside a tangent which extends in the direction of displacement of the said transfer device and which is applied to a periphery of said punch and is disposed in the longitudinal direction immediately in front of the said front abutment surface of said die.

11. A forging press according to claim 8 wherein said transfer device with said at least one of said grippers is displaceable exclusively in the direction of the tangent but not transversely with respect thereto towards and away from the longitudinal axis.

12. A forging press device according to claim 1 wherein said first and second setting devices are driven by electro servo motors.

* * * * *